United States Patent [19]

Oklejas et al.

[11] 4,255,081

[45] Mar. 10, 1981

[54] CENTRIFUGAL PUMP

[76] Inventors: Robert A. Oklejas, 3311 Lakeview Dr., Baycrest Beach, Monroe, Mich. 48161; Eli Oklejas, 517 W. Madison St., Apt. 5, Lansing, Mich. 48906

[21] Appl. No.: 46,457

[22] Filed: Jun. 7, 1979

[51] Int. Cl.[3] ..... F01D 1/36

[52] U.S. Cl. ..... 415/90

[58] Field of Search ..... 415/76, 90

[56] References Cited

U.S. PATENT DOCUMENTS 1,013,248 1/1912 Wilkinson ..... 415/90

FOREIGN PATENT DOCUMENTS 128235 3/1960 U.S.S.R. ..... 415/90

*Primary Examiner*—Billy J. Wilhite

*Attorney, Agent, or Firm*—Charles R. Schaub

[57] ABSTRACT

The invention is directed to a rotor for a centrifugal pump. The rotor has a plurality of spaced apart, substantially circular, rotatable and substantially parallel disks. The disks contain a center aperture. A plurality of arcuate vanes are connected to the outer peripheral edge of the disks. The vanes extend from the outer peripheral edge of the disks in a direction away from the center aperture in the disks.

6 Claims, 6 Drawing Figures

CENTRIFUGAL PUMP

BACKGROUND OF THE INVENTION

This invention relates to a centrifugal pump utilizing a multiple disk rotor for pumping a fluid. In one of the more specific aspects of the invention, a plurality of vanes are combined with the multiple disks of the rotor.

Centrifugal pumps have been known for a number of years. In fact centrifugal pumps utilizing a vaned rotor have had wide commercial success because of the durability, low cost and high efficiency of such pumps. In centrifugal pumps a fluid is forced to circulate around a given point, this circulation of a fluid is called vortex circulation. During the circulation of the fluid a radial pressure gradient is created in the fluid. The gradient is such that the pressure increases with increasing radial distance from the center of rotation. The rate of the pressure increase depends upon the speed of rotation of the vaned rotor and the density of the fluid being pumped. An external force must act on the fluid to create the vortex circulation. The force must accelerate the fluid in the tangential direction, as the fluid moves outward, in order to maintain the angular velocity of the fluid. The force supplied to the fluid transfers momentum to the fluid. In a pump using a conventional vaned rotor the vanes and rotor walls form a channel for the fluid. As the channel is rotated the fluid accelerates as it moves outwardly into regions of higher rotor velocity. The acceleration of the fluid in the channel transfers momentum to the fluid. The conventional pump utilizing a vaned rotor has been especially successful in moving low viscosity fluids at a high flow rate.

However, there are a number of deficiencies associated with the pump using a vaned rotor. These deficiencies seriously limit the application range for such pumps.

Most of the difficulties associated with a pump utilizing a vaned rotor occur at the inlet region where the fluid is first introduced into the pump. The impact of these difficulties are that a vaned rotor pump can have cavitation problems, a low efficiency when pumping viscous fluids and a low resistance to wear when pumping abrasive fluids. Although some of these deficiencies can be overcome by modifications to the pumping system such modifications are usually expensive and limit the performance of the pump.

When the vanes on a rotor and a pump move through a fluid they produce a pressure distribution that has a positive pressure on the advancing face of the vane and a negative pressure on the retreating face. The intensity of the negative pressure zone depends on the radial flow velocity of the fluid along the vanes and the velocity at which the rotor is rotating. This type of pressure distribution is inherent in a pump utilizing a vaned rotor. Cavitation can occur in the negative pressure zone in the area having the lowest static pressure. In a vaned rotor, the lowest pressure is at the fluid inlet, and more specifically on the retreating side of the vanes at the fluid inlet. If the static pressure on the fluid in the pump drops below the vapor pressure for the fluid, vapor pockets will be formed. Cavitation occurs when such vapor pockets are formed in the rotor of the pump. Of course, cavitation severely restricts the performance of the pump. Also, since cavitation occurs at the fluid inlet to the pump, cavitation difficulties will impair the operational efficiency of the entire vaned rotor pump.

The only way to prevent cavitation is to provide enough inlet pressure so that even the low pressure areas at the fluid inlet to the rotor have sufficient pressure so that the static pressure is higher than the vapor pressure of the fluid. However, it is very expensive to provide sufficient inlet pressure to the pump to suppress cavitation. Also the environment in which the pump is being used may not allow for modifications to increase the inlet pressure to a point that is sufficient to suppress cavitation.

Viscous fluids also adversely effect the performance of a pump using a vaned rotor. The difficulty occurs because there is a non-uniform pressure distribution on the vanes of the rotor. The non-uniform pressure distribution occurs at the inlet region of the pump where the viscous fluid is first engaged by the vanes of the rotor. The fluid flow interacting with the vanes of the rotor generate Karman Vortices along the retreating face of the vanes. The vortices represent lost momentum that could have been used to pump the fluid. The loss of momentum occurs in this type of pump regardless of the viscosity of the fluid, but the effects of this loss of momentum are more severe with viscous fluids. Thus, a pump utilizing a vaned rotor has reduced efficiency when pumping viscous fluids.

When pumping abrasive fluids the rate of abrasion is a function of a type of concentration of the particles in the fluid and the relative velocity between the surface of the rotor and adjacent fluid layer. There is a layer of relatively quiescent fluid, called the boundary layer, adjacent to the surfaces of the rotor. The thickness of the boundary layer is mainly determined by the Reynolds number of the fluid. The boundary layer will provide a protective layer of fluid that helps to prevent the particles in the abrasive fluid from coming in contact with the surface of the rotor. However, the effectiveness of the boundary layer is significantly reduced when the thickness of the boundary layer is decreased.

In a pump utilizing a vaned rotor the fluid being pumped undergoes an abrupt acceleration and change of direction as the fluid enters the rotor. The changes in acceleration and direction of flow of the fluid act to reduce the thickness of boundary layer. As the boundary layer is reduced in thickness the particles of the fluid pass across the rotor surface at approximately the velocity at which the fluid is traveling. This produces a strong abrading action on the surface of the rotor. Again the effects of the abrasive fluids are greatest at the inlet region of the rotor where the fluid undergoes abrupt acceleration and changes of direction. Thus, when pumping abrasive fluids the inlet region of the rotor will receive the most damage and be the first area of the rotor to fail.

From the above it is clear that a pump utilizing a traditional vaned rotor is significantly limited in application by the inlet conditions inherent in such a pump. These limitations significantly reduce the areas of application for such pumps.

Another type of centrifugal pump that has been known is the multiple disk pump. This pump was originated by Nikola Tesla and he was granted a patent (U.S. Pat. No. 1,061,142) in 1912 on this pump concept. This pump utilizes a plurality of rotating disks as the rotor for the pump. The rotating disks utilize viscous drag to transfer momentum to the fluid to be pumped. Viscous drag results from the natural tendency of a fluid to resist flow. Viscous drag occurs whenever a velocity difference exists between a fluid and the constraining channel in which the fluid is located. Viscous drag always acts to reduce the velocity difference between the fluid and the moving channel or the rotor.

Although the Tesla multiple disk pump has been known for a number of years the pump has never been commercialized or seriously pursued in the pump industry. At least part of the reason for this lack of development of the Tesla pump is that there are some significant performance limitations with this type of pump. The efficiency of the multiple disk rotor decreases at higher flow rates for the pumped fluid. In addition, a relatively large number of disks are required to achieve pump efficiency when a low viscosity fluid is being pumped. The number of disks required has a direct relationship to the manufacturing costs of the rotor and casing for the pump. Also the multiple disk rotor is not inherently rugged. The disks are usually constructed from a relatively thin material but this material must be stiff enough to prevent flexure during the operation of the pump. In view of these limitations the Tesla type multiple disk rotor pump has never been effectively commercialized.

SUMMARY OF THE INVENTION

An object of the invention is to provide an improved multiple disk centrifugal pump.

An additional object of the invention is to provide a rotor for a centrifugal pump having multiple disks and a plurality of vanes.

Other objects and advantages of the invention will become apparent as the invention is described hereinafter in more detail with reference to the accompanying drawings.

DESCRIPTION OF THE PREFERRED EMBODIMENTS

This invention relates to a centrifugal pump for pumping fluids. The features of this invention will be more fully understood by referring to the attached drawings in connection with the following description.

Figure 1:
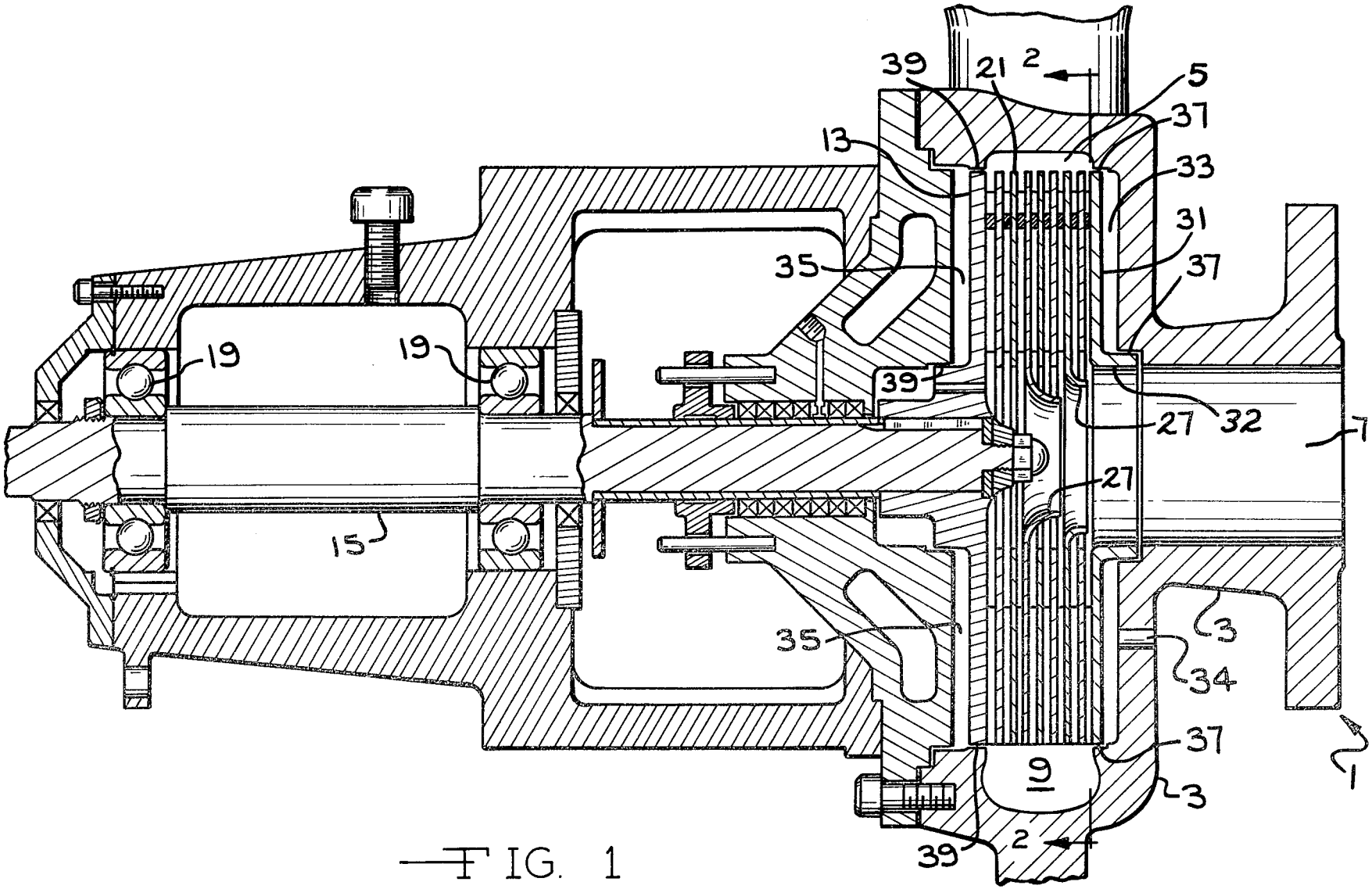
FIG. 1 is a cross sectional view of the pump in accordance with the present invention.
Figure 2:
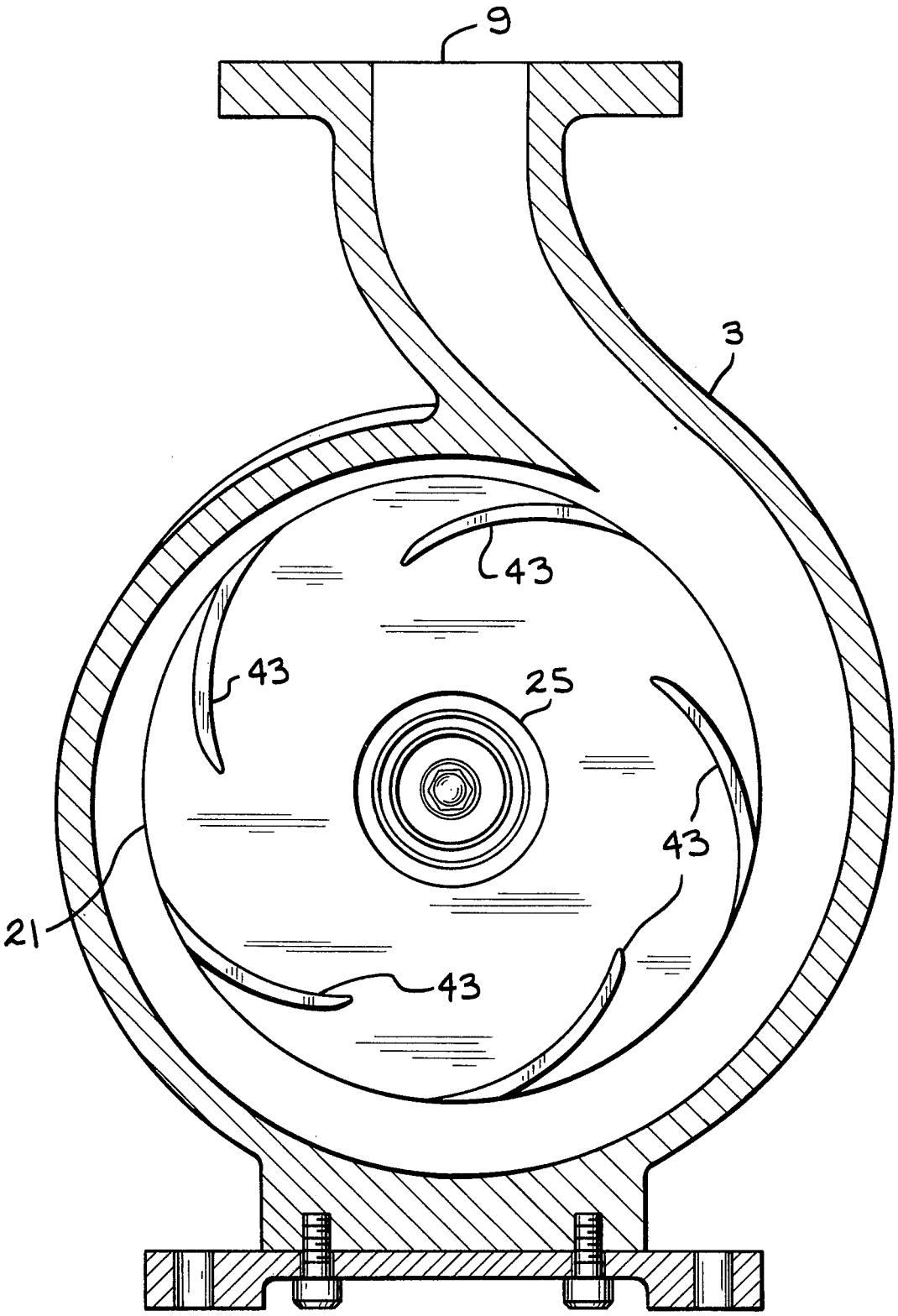
FIG. 2 is a cross sectional view taken along line 2—2 in FIG. 1.

FIGS. 1 and 2 show the details of the pump. The pump 1 has an outer housing or casing 3 that defines a chamber 5. The housing and chamber are generally cylindrical in shape. The chamber 5 has an inlet opening 7 and discharge opening 9. The inlet (suction) opening 7 is positioned on the chamber to provide an inlet into the center of the chamber. The discharge opening is positioned on the outer peripheral edge of the chamber.

A cylindrical member 31 is positioned adjacent the inlet opening 7 to the chamber. The circular member 31 contains an aperture 32 that is positioned substantially in the center of the member. The aperture is in registry with the inlet opening 7 to the chamber 5. The circular member 31 is positioned so that it is substantially perpendicular to the longitudinal axis of the inlet opening 7. The circular member 31 defines one wall of the chamber 5.

The member 31 is positioned in the housing so that a cavity 33 is formed between the circular member and the housing 3. Seals 37 are provided between the member 31 and the housing 3 to seal the cavity 33 from the chamber 5. Thus, the circular member 31 defines one wall of the chamber 5 and one wall of the separate cavity 33. Both the chamber 5 and cavity 33 are located within the outer housing of the pump. A passageway 34 is provided that passes through the outer housing and connects to the cavity 33. Means for sealing the passageway (not shown) can be provided to seal the passageway and cavity from the environment around the pump.

A rotatable impeller hub 13 is positioned opposite the inlet opening in the interior of the outer housing 3. The impeller hub 13 is substantially parallel to the circular member 31 and defines one wall of the chamber 5. The impeller hub is mounted on impeller shaft 15 that is rotatably positioned in the housing 3. Bearings 19 provide radial and axial support for the impeller shaft. A motor (not shown) is provided to rotate the impeller shaft. The impeller hub 13 is mounted on the impeller shaft 15 so that a cavity 35 is formed between the impeller hub and the housing 3. Seals 39 are provided between the impeller hub 13 and the housing 3 to seal the cavity 35 from the chamber 5. Thus, the impeller hub 13 is used to define one wall of the chamber 5 and one wall of the cavity 35. In both the chamber 5 and cavity 35 are located within the outer housing 3 of the pump. A passageway (not shown) can be provided through the outer housing that connects to the cavity 35.

A plurality of substantially parallel, spaced apart, circular disks 21 are mounted between the circular member 31 and the impeller hub 13. The circular disks are substantially parallel to the circular member 31 and the impeller hub 13. The disks contain an aperture 25 that is positioned substantially in the center of the disk. The aperture 25 is located in registry with the inlet opening 7 to the chamber 5. The spacing between the circular disks 21 is substantially uniform. The outer peripheral edge of the circular disks 21 terminate at substantially the same place in the chamber 5 as the outer peripheral edges of the circular member 31 and the impeller hub 13. The circular disks 21 are positioned between the member 31 and impeller hub 13 so that the disks are securely attached to the impeller hub and the circular member. The disks are mounted co-axially on the impeller hub. It should also be noted that the number of disks and the spacing between the disks can be varied to meet various pump requirements.

In FIG. 1 two disks are shown that have a curved portion 27 positioned adjacent the center aperture 25 in the disk. The curved portions 27 extend the circular disks 21 so that there is a portion of the disks that is substantially parallel to the longitudinal axis of the inlet opening 7. The curved portion 27 is also connected to the remainder of the circular disk which is perpendicular to the longitudinal axis of the inlet opening 7. The curved portions 27 act as a guide to direct fluid to the spaces between the disks. Additional disks or all of the disks can contain curved portions if desired to improve the flow of fluid to the spaces between the disks. The radius of the curved portions 27 can be varied or selected to assist in providing equal fluid flow to each space between the disks. The best position and shape for the curved portions of the disks is dependent upon the inlet velocity of the fluid entering the pump. Thus, if the inlet velocity of the fluid is known the curved portions of the disks can be designed to maximize the performance at the inlet region of the pump.

A plurality of vanes 43 are positioned between the adjacent circular disks 21. The vanes have an arcuate shape and extend from an outer peripheral edge of the edge of the disks towards the center aperture of the disks. In FIG. 2 the vanes are shown as extending approximately one-third of the distance from the outer peripheral edge to the center aperture of the disks. However, it should be recognized that vanes of different length can be utilized in the pump. In practice, it has been found that the vanes can extend from about ¼ to about ¾ of the distance from the outer peripheral edge to the center aperture of the disks. The vanes can also vary in shape and angular position from the vanes shown in FIGS. 1 and 2. The vanes extend from the surface of one disk to the surface of the adjacent disk. There are also vanes positioned between the circular member 31 and the adjacent disk, and between the impeller hub 13 and the adjacent disk. The circular member, impeller hub and disks are all secured to the vanes. Accordingly, the vanes help to secure these components into a single unit. The vanes can also be utilized to maintain the proper spacing between the disks and to help prevent the disks from moving or flexing during operation of the pump. The number of vanes used and the position of the vanes will be determined by the performance characteristics desired for a particular pump. However, the vanes 43 are normally positioned in substantially the same location between the adjacent disk.

The member 31, impeller hub 13, disks 21 and vanes 43 form the rotor of the pump. The rotor is positioned in the chamber 5 defined in the outer housing 3. However, the rotor does not completely fill the chamber 5. There is a space defined around the outer periphery of the rotor. The discharge opening 9 is located in a portion of the space around the outer periphery of the rotor.

Figure 4:
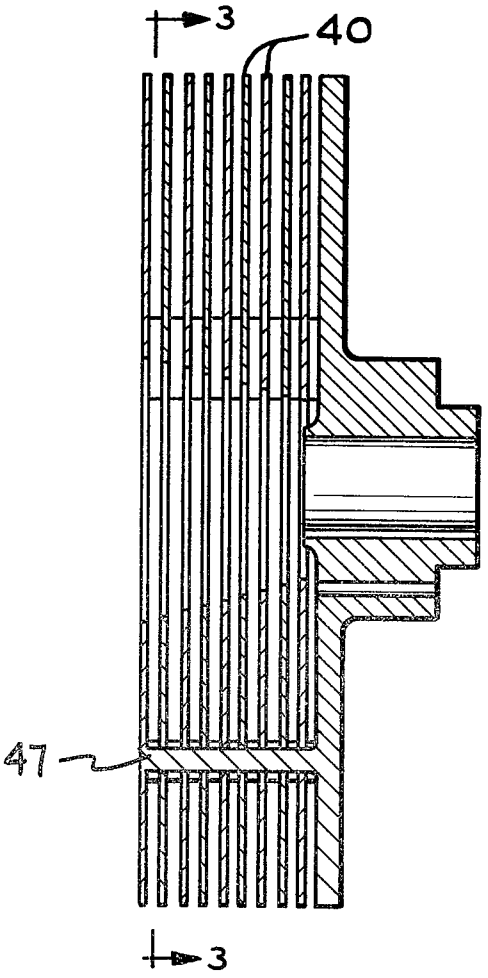
FIG. 4 is a cross sectional view taken along line 4—4 in FIG. 3.
Figure 3:
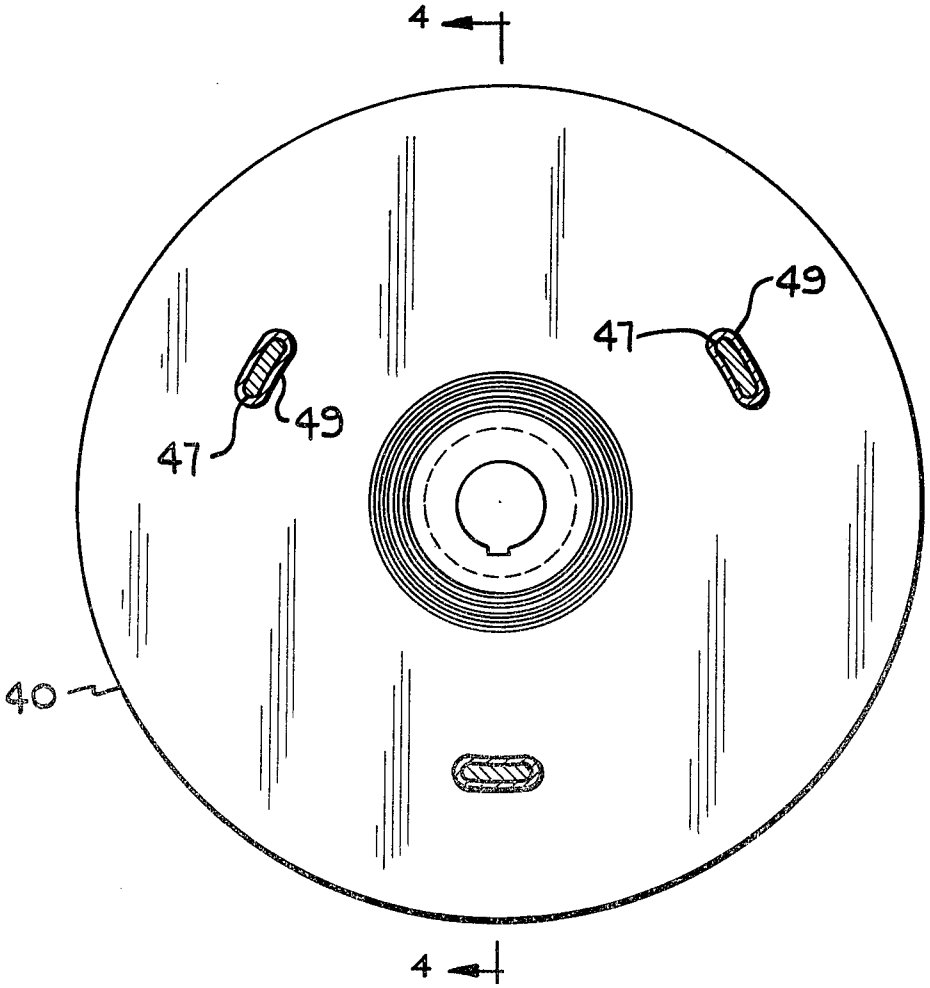
FIG. 3 is a cross sectional view taken along line 3—3 in FIG. 4.

FIGS. 3 and 4 show another embodiment for a rotor for a centrifugal pump. The disks 40 of the rotor contain apertures 49 that are located approximately midway between the center aperture of the disks and the outer peripheral edge of the disks. A rod 47 projects perpendicularly from the surface of the impeller hub. The rod 47 can be cast as part of the impeller hub, welded to the hub or be otherwise suitably secured to the hub. The disks are positioned on the rod 47 so that there is a substantially uniform spacing between the circular disks of the rotor. Vanes (not shown) can be positioned between the disks as the disks are positioned on the rod 47. Also a circular member (not shown) can be positioned opposite the impeller hub and securely to the rods 47 to complete the rotor assembly.

The disks and other components of the rotor assembly can be secured to the rod 47 by brazing, spot welding or any other suitable attachment method. However, in practice it has been found to be particularly advantageous to utilize a process known as furnace brazing to secure the pieces of the rotor together. In furnace brazing the components to be joined together are coated, at the points to be joined, with an appropriate brazing compound. The components are then put together and placed in a furnace. The heat from the furnace causes the brazing compound to securely join together the various components. In furnace brazing the components are subjected to a substantially uniform heat and the components are always at substantially the same temperature. The uniform temperature of the furnace brazing operation reduces thermal stresses and temperature differentials that can deform the components of the rotor.

As shown in FIG. 3 the rod 47 has an oblong or elongated cross-section. The apertures 49 in the disks 40 have a similar oblong or elongated shape. It should also be noted that the edges of the oblong rod have a curved or rounded configuration.

The apertures 49 and the disks 40 can be advantageously formed by a stamping operation. The stamping operation should be set up so that the aperture is formed by moving metal away from the area where the aperture is to be located. This metal should be moved so that it extends from the edge of the aperture 49 in a direction that is perpendicular to the surface of the disks. The metal so moved by the stamping operation will be located adjacent the surface of the rod 47 when the disks are positioned on the rod 47. Spacer washers can also be positioned on the rods between the disks. The spacer washers will act to keep a proper spacing between the disks and keep the disks substantially parallel.

Figure 6:
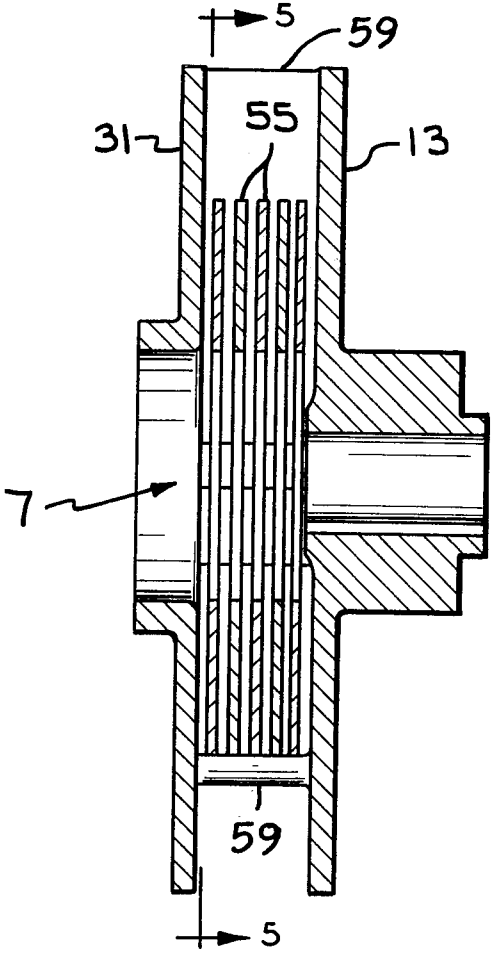
FIG. 6 is a cross sectional view taken along line 6—6 in FIG. 5.
Figure 5:
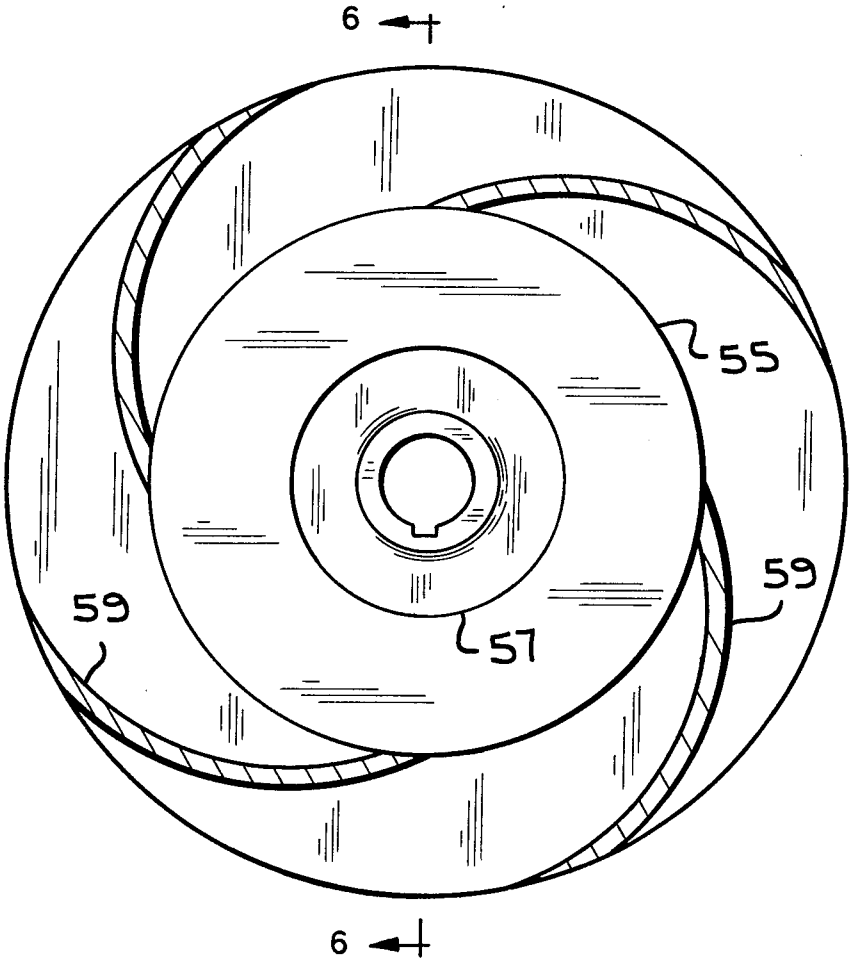
FIG. 5 is a cross sectional view taken along line 5—5 in FIG. 6.

FIGS. 5 and 6 show another embodiment of a rotor that can be used in the centrifugal pump of this invention. In this embodiment a circular member 31 and an impeller hub 13 are positioned in a chamber 5 formed by the housing of a pump, as previously described. A plurality of disks 55 are positioned between and connected to the circular member and impeller hub. The disks are substantially the same as the previously described disks 21 except that the disks 55 do not extend to the outer peripheral edge of the circular member 31 and the impeller hub 13. The disks 55 only extend approximately one-half the distance from the center aperture 57 to the outer periheral edge of the circular member 31 and impeller hub 13.

At the outer perpheral end of the disks 55 there are located a plurality of vanes 59. The vanes 59 extend from the outer peripheral edge of the disks 55 to the outer peripheral edge of the circular member 31 and the impeller hub 13. The vanes 59 are connected to the outer peripheral edge of the disks and extend completely between the impeller hub 13 and the member 31. The outer peripheral edge of the disks 55 are securely attached to the vanes 59 and the vanes 59 act to secure the disks 55 to the circular member 31 in the impeller hub 13. The vanes 59 also position the disks in the rotor and provide a substantially uniform spacing between the disks. The vanes considerably strengthen the rotor assembly in this embodiment. The vanes can be connected to the disks 55, impeller hub 13 and circular member 31 by brazing, spot welding or any other suitable method.

In the operation of the pump shown in FIGS. 1 and 2 the fluid to be pumped is introduced into the pump 1 through inlet opening 7. The fluid moves into the chamber 5 that communicates with the inlet opening. The fluid entering the chamber 5 flows into the spaces provided between the plurality of disks 21. The curved portions 27 located on two of the disks 21 will assist the fluid entering the inlet opening the change direction and to flow into the spaces between the disks. The curved portions 27 on the disks 21 change the direction of the fluid entering the pump from the axial to a radial direction. The change in direction is accomplished in a smooth shockless manner. By changing the direction of the fluid entering the pump, at least a portion of the inlet velocity of fluid can be recovered and utilized by the rotor of the pump. Recovering at least a portion of the inlet velocity of the fluid helps to increase the efficiency of the pump.

When fluid is introduced into the chamber 5 the impeller shaft 15 is caused to rotate by a motor (not shown). The rotation of the impeller shaft causes the rotor of the pump 1 to rotate.

The rotation of the rotor causes the fluid positioned between the disks, between the disks and the impeller hub and between the disks and the circular member to also rotate. The rotating rotor transfers momentum to the fluid. Most of the momentum transferred to the fluid is accomplished by the rotation of the disks 21. As the disks rotate the fluid positioned in the spaces between the disks is also caused to move. The viscous drag of the fluid allows momentum to be transferred from the rotating disks 21 to the fluid. Viscous drag results from a natural tendency of a fluid to resist flow. Viscous drag will occur whenever a velocity difference exists between a fluid and the constraining channel in which the fluid is located. The effect of viscous drag is to reduce the velocity difference between the fluid and the constraining channel. Thus, as the rotor rotates the fluid will move in the direction of rotation of the rotor and move radially away from the center of the rotor. However, the fluid always moves at a speed that is slower than the speed at which the adjacent portion of the rotor is traveling. The momentum transfer begins slowly at the center of the disks adjacent the fluid inlet 7 and increases as the fluid moves radially further away from the center of the disk. The fluid travels in a substantially spiral path from the center of the disks to the outer periphery of the disks. As the fluid moves away from the center of the plurality of disks the speed of the fluid increases.

As the fluid moves towards the outer periphery of the disks, the fluid is engaged by the vanes 43 that are positioned between adjacent disks. The vanes also impart a momentum transfer to the fluid being pumped. The vanes and disks define a channel in which the fluid is confined. The fluid is accelerated in the channel defined by the vanes and disks as the fluid moves radially outward into regions of higher rotor velocity. Thus, once the vanes 43 engage the fluid, the fluid will be caused to accelerate as it moves further and further away from the center of the rotor.

The use of the disks to transfer momentum to the fluid reduces the problems that are normally associated with pumps that use the impeller or rotor containing vanes. The momentum transfer by the disk portion of the rotor increase the speed of the fluid so that it is close to the speed of the vanes. Also, there is very little change of direction of the fluid advanced by the disks when the fluid is engaged by the vanes. Accordingly, there is a minimum of disruption at the location where the fluid is engaged by the vanes. Also the disks increase the static pressure on the fluid as the fluid is advanced by the disks. The static pressure on the fluid will increase until the static pressure is higher than the vapor pressure of the fluid. When this occurs the static pressure on the fluid acts to suppress cavitation in the fluid. The vanes 43 are positioned in the rotor assembly so that the fluid engaged by the vanes will be under sufficient static pressure to suppress cavitation.

The disk portion of the rotor, therefore, does a good job of providing initial momentum transfer to the fluid. The disks easily handle the fluid at the inlet opening 7 and begin pumping the fluid. The velocity and static pressure imparted to the fluid optimizes the conditions of the fluid for engagement by the vanes of the rotor. Thus, the disks and vanes cooperate to maximize the performance of the rotor.

The vaned portion of the rotor is used to provide high efficiency momentum transfer at high flow rates to the fluid. A substantial portion of the momentum transferred to the fluid will be produced by the vaned portion of the rotor while the disks protect the vanes from the effect of adverse fluid inlet conditions. The increase in fluid pressure in the vaned portion of the rotor can be from about 5 to about 20 times the increase in fluid pressure in the disk portion of the rotor.

As the fluid leaves the rotor the fluid moves into the outer periphery of the chamber 5. The fluid is under pressure and passes through the discharge opening 9 located in the outer periphery of the chamber. The pressure and velocity at which the fluid is discharged from the pump is dependent upon the number of disks in the rotor, the size of the spaces between the disks, the number of vanes, the configuration of the vanes, the rotational speed of the rotor and the viscosity of the fluid being pumped. By varying the above factors the pump can be modified to pump most fluids efficiently at the desired pressure and flow rate.

As the rotor rotates, it should be noted that the circular member 31 and impeller hub 13, which are part of the rotor, are also rotating. The circular member and impeller hub form at least a portion of two of the walls of the chamber 5 through which the fluid is pumped. Since at least a portion of two walls of the chamber are moving with the fluid being pumped, there will be less stationary wall area in the chamber 5 that the fluid will have to flow past. Reducing the stationary wall area will reduce the frictional drag on the fluid being pumped. Reduction in the frictional drag helps to increase the efficiency of the pump. In addition, cavities 33 and 35 have been positioned contiguous to the chamber 5, adjacent the impeller hub and circular member. The cavities are separated from the chamber 5 by seals 37 and 39. The cavities effectively separate the chamber 5 from the rest of the outer housing 3 of the pump. The cavities act, in certain applications involving viscous or viscous acting liquids, to reduce frictional drag between the rotating circular member 31 and impeller hub 13 of the chamber 5 and the outer housing of the pump. The cavities 33 and 35 can be filled through the passageways provided, with a fluid having a low viscosity. The low viscosity fluid in the cavities will act to reduce frictional drag between the outer housing 3, and the rotating circular member and impeller hub. It should also be noted that fluid in cavities 33 and 35 will be heated by the frictional drag produced in the cavities by the rotating circular member and impeller hub. Generally when a fluid is heated the viscosity of the fluid will decrease. Since frictional losses are proportional to viscosity, as the viscosity decreases the frictional losses will decrease. Thus, if there is fluid in cavities 33 and 35 the temperature of the fluid will increase, the viscosity of the fluid will decrease and the frictional losses on the rotor will decrease.

The pump shown in FIGS. 1 and 2 can also be used to pump abrasive fluids. Abrasive fluids usually contain particles that can abrade surfaces that the particles contact. However, there is a boundary layer of fluid, adjacent the surface of the pump, that provides protection for the components of the pump. The thickness of the boundary layer is initially determined by the Reynolds number of the fluid. However, abrupt acceleration and changes in direction of the fluid in the pump can significantly reduce the thickness of the boundary layer. If the thickness of the boundary layer is reduced sufficiently, the abrasive particles in the fluid can abrade directly against the components of the pump. In the pump shown in FIGS. 1 and 2 the rotor does not subject the fluid being pumped to any abrupt acceleration or changes in direction. At the fluid inlet the fluid moves into the spaces provided between the disks 21. The fluid is then caused to gradually increase its velocity by the rotation of the disks. When the fluid engage the vanes 49, the fluid is traveling at approximately the same velocity and in approximately the same direction as the initial portion of the vanes. Therefore, there are no abrupt changes for the fluid to undergo. Thus, the protective boundary layer is maintained in the rotor of the pump and abrasive fluid can be successfully pumped. The only limitation on the pumping of the abrasive fluids is that the size of the particles in the fluid must be smaller than the spacings between the disks 21.

FIGS. 3 and 4 show the configuration of another embodiment of a rotor assembly in more detail. The rotor of this embodiment is used primarily where there are no vanes positioned between the disks or where the length of the vanes is insufficient to provide adequate connection bearing surface to properly support the disks. In a multiple disk rotor it is desirable to have as few obstructions as possible in the flow path of the fluid. However, in this rotor, rods 47 are used to connect together the components of the rotor. The rods are obstructions that disrupt the flow path of the fluid being pumped, which reduces the capacity and efficiency of the pump. To minimize the disruption to the fluid flow the rods 47 have an oblong or elongated cross section. The shape of the rods 47 also reduces turbulance in the areas of the rods.

The fluid being pumped enters the spacings between the disks at the center aperture and then moves in a substantially spiral path to the outer peripheral edge of the rotor. When the fluid enters the region where the rods 47 are positioned, the spiral path of advancement by the fluid will cause the fluid to come into contact with the narrower end regions of the oblong rods. The thinner frontal area and rounded edges presented to the fluid will reduce the resistance to flow and turbulance in the area of the rods. The fluid will also flow generally smoothly along the flat surfaces of the rods 57 as the fluid advances past the position of the rods. The oblong cross section of the rods also provides a sufficient cross section area to which the disks 21 can be attached to the rods. Thus, the shape of the rods 47 reduces disruption to the flow of the fluid and provides adequate area to securely fasten the disks 21 to the rods. The cross sectional area of the rods also allows the rods to have sufficient strength to hold the rotor assembly together during the operation of the pump.

FIGS. 5 and 6 show an additional embodiment for a rotor suitable for use in the centrifugal pump of this invention. The fluid enters the chamber through inlet opening 7 and moves into the spaces provided between the disks 55 generally as previously described. However, in this embodiment the disks 55 do not extend across the entire width of the circular member 31 and the impeller hub 13. When the fluid reaches the outer peripheral edge of the disks 55 the fluid is engaged by the vanes 59 which extend from the outer peripheral edge of the disks 55 to the outer peripheral edge of the circular member 31 and the impeller hub 13. The fluid being engaged by the vanes 59 will be traveling at approximately the same speed at which the portion of the vanes immediately adjacent the outer peripheral edge of the disks are traveling. The fluid will also be traveling in approximately the same direction as the vanes 59. Therefore, the fluid will smoothly flow from the outer peripheral edge of the disks 55 into the portion of the rotor containing the vanes 59. The vanes will act to greatly accelerate the fluid and to increase the pressure gradient in the fluid prior to the fluid exiting the chamber through a discharge opening. In this embodiment the vanes 59 act to secure the circular member 31, impeller hub 13, disks 55 and vanes 59 into a single rotor assembly. The vanes 59 also secure the disks 55 in the rotor assembly and maintain the proper spacing between the disks.

Having described the invention in detail and with reference to the drawings, it will be understood that such specification are given for the sake of explanation. Various modifications and substitutions other than those cited can be made without departing from the scope of the invention as defined by the following claims.

We claim:

1. A rotor for a centrifugal pump comprising:

a plurality of spaced apart, substantially circular, rotatable and substantially parallel disks, the disks containing a center aperture; and a plurality of arcuate vanes connected to the outer peripheral edge of the disks, the vanes extending from the outer peripheral edge of the disks in a direction away from the center aperture in the disks.

2. The rotor of claim 1 wherein a rotatable shaft is positioned in the centrifugal pump, an impeller hub being connected to the rotatable shaft, a circular member being positioned in the centrifugal pump in spaced apart, substantially parallel relationship to the impeller hub, the plurality of disks being mounted between the impeller hub and the circular member.

3. The rotor of claim 2 wherein the diameter of the disks is less than the diameter of the impeller hub and circular member.

4. The rotor of claim 3 wherein the vanes extend from the outer peripheral edges of the disks to the outer peripheral edge of the impeller hub and circular member.

5. The rotor of claim 4 wherein the vanes extend from the impeller hub to the circular member.

6. The rotor of claim 5 wherein the vanes position the plurality of disks between the impeller hub and circular member.

* * * * *